US005179941A

United States Patent [19]

Siemssen et al.

[11] Patent Number: 5,179,941

[45] Date of Patent: Jan. 19, 1993

[54] CONTRACTILE SLEEVE ELEMENT AND COMPRESSION SLEEVE MADE THEREFROM FOR THE PERISTALTIC TREATMENT OF EXTREMITIES

[75] Inventors: Siems O. Siemssen, 26 Hoyrups Alle, DK-2900 Hellerup; Ole Lynnerup, Copenhagen, both of Denmark

[73] Assignee: Siems Otto Siemssen, Hellerup, Denmark

[21] Appl. No.: 651,231

[22] PCT Filed: Jun. 6, 1989

[86] PCT No.: PCT/DK89/00139

§ 371 Date: Feb. 7, 1991

§ 102(e) Date: Feb. 7, 1991

[87] PCT Pub. No.: WO89/11845

PCT Pub. Date: Dec. 14, 1989

[30] Foreign Application Priority Data

Jun. 7, 1988 [DK] Denmark ..... 3082/88

[51] Int. Cl.[5] ..... A61H 1/00; A61H 7/00

[52] U.S. Cl. ..... 128/40; 128/64; 128/24 R; 606/201

[58] Field of Search ..... 128/24 R, 165, 64, 38, 128/39, 40, 728; 137/624.18, 909; 606/201, 202, 203

[56] References Cited

U.S. PATENT DOCUMENTS 726,791 4/1903 Armbruster .
3,548,809 12/1970 Conti .
3,824,992 7/1974 Nicholson et al. .
3,826,249 7/1974 Lee et al. .
3,859,989 1/1975 Spielberg ..... 128/24 R
3,862,629 1/1975 Rotta .
3,896,794 7/1975 McGarth ..... 128/24 R
4,091,804 5/1978 Hasty .
4,156,425 5/1979 Arkans .
4,311,135 1/1982 Brueckner et al. .
4,343,302 8/1982 Dillon .
4,374,518 2/1983 Villanueva ..... 128/64
4,738,249 4/1988 Linman et al. ..... 128/24 R
4,762,121 8/1988 Shienfeld ..... 128/64

FOREIGN PATENT DOCUMENTS 2754765 6/1978 Fed. Rep. of Germany .
3440638 5/1985 Fed. Rep. of Germany .
1135330 12/1968 United Kingdom .

*Primary Examiner*—Richard J. Apley
*Assistant Examiner*—John P. Leubecker
*Attorney, Agent, or Firm*—Bacon & Thomas

[57] ABSTRACT

A contractile stocking element (10) intended to form together with further stocking elements of the same type a compression sleeve for peristaltically treating patients' lower extremities, consists of a hose to be disposed around the patient's limb and which is made from flexible material, the hose being substantially more flexible in its longitudinal direction than in its transverse direction, and carrying a fabric strip (12) with hooking means of the Velcro-type (13) at the ends of the strip and being intended to constrict around the patient's limb upon establishment of a partial vacuum in the interior of the hose. The individual stocking elements of the compression sleeve are activated sequentially by a control arrangement with a sequence control circuit.

8 Claims, 2 Drawing Sheets

FIG. 1
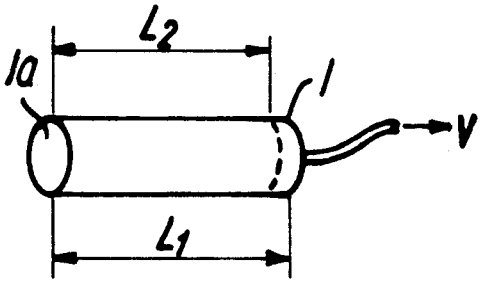
FIG. 2
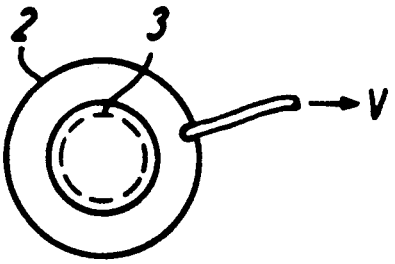
FIG. 3
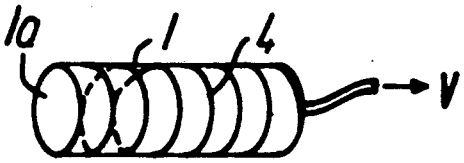
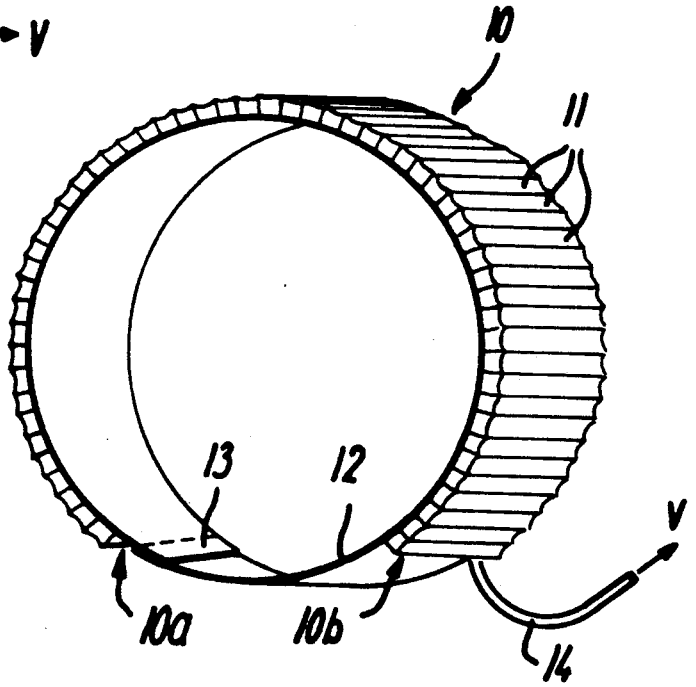
FIG. 5
FIG. 4
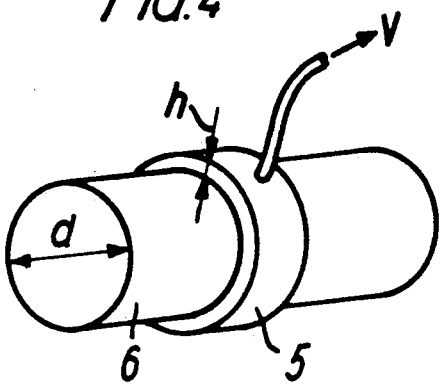

CONTRACTILE SLEEVE ELEMENT AND COMPRESSION SLEEVE MADE THEREFROM FOR THE PERISTALTIC TREATMENT OF EXTREMITIES

BACKGROUND OF THE INVENTION

A contractile sleeve element and compression stocking consisting of a plurality of such elements for the peristaltic treatment of a patient's extremities.

The invention relates to a contractile sleeve element for use in the peristaltic treatment of patients' extremities and of the type comprising at least one sleeve means to be wrapped around a patient's leg/arm.

Regarding operations under a complete anaestetic, thrombosis in the lower extremities is a frequent complication, particularly in elderly patients, resulting in a possible development of fatal pulmonary complications.

Various circumstances influence the formation of thrombi in extremities, viz. biochemical and hemodynamic conditions (decreased flow and turbulence of the blood flow) under complete anaestetic, thereby impeding the function of the muscle pump under normal conditions.

Besides the treatment with medication, various forms of compression stockings for a long time have been used for the peristaltic compression of extremities.

U.S. Pat. No. 3,862,629 discloses a compression stocking comprising a stocking placeable around the patient's leg with a number of encircling pressure hoses or pressure chambers successively supplied with pressurized air by a suitable control sequence arrangement, thereby locally and successively subjecting the patient's limb to compression.

U.S. Pat. No. 4,091,804 discloses a compression stocking consisting of a supporting sheet of flexible material to be placed around the patient's limb, said sheet being combined with a second sheet in such a manner as to form a number of chambers supplied with pressurized air by a suitable sequential control, thereby allowing said chambers to locally and successively compress the patient's limb.

Various alternative patents deal with compression stockings which may likewise be divided into successively actuable pressure chambers (U.S. Pat. No. 3,826,249, U.S. Pat. No. 4,311,135, DE-OS 34 04 638) or which are designed without a division of the pressure chambers but accommodated within a pressure box (U.S. Pat. Nos. 3,824,992 and 4,343,302).

From U.S. Pat. No. 4,311,135 a compression stocking is known in which a number of stocking tubular members supported by a common sheathing are arranged around the patient's limb.

A common characteristic of all said prior art designs is that they all make use of air pressure (positive pressure) to actuate the individual pressure chamber elements so that there is either atmospheric pressure in said elements if no compression is wanted, or if compression is wanted there is a positive pressure.

BRIEF SUMMARY OF THE INVENTION

A contractile sleeve element in accordance with this invention differs from the prior art in that said sleeve means is capable of being deformed substantially more in its longitudinal direction than in its transversal direction and that an opening is provided in the wall of said sleeve means for air-evacuation, which causes said sleeve means to longitudinally contract so as to apply pressure around the patient's limb.

A series of substantial technical advantages are obtained by a contractile sleeve element designed as specified above.

A width of a few centimeters is suggested for the sleeve element which the doctor may wrap round the patient's limb. In view of the fact that said sleeve means may be deformed more in its longitudinal direction than in its transversal direction, it will contract in its longitudinal direction corresponding to the circumferential direction around the limb due to the evacuation of air from the sleeve.

The sleeve element will thus constrict around the limb as long as partial vacuum prevails in the interior of said sleeve means. The fact that it is connected with the supporting strip ensures that the pressure influence is directed towards the limb and that the contraction of the sleeve will be distributed across the width of the sleeve instead of being localized in a confined area along the limb as is the case according to the prior art (U.S. Pat. Nos. 3,862,629 and 4,311,135).

Moreover, one or more such sleeve-like stocking element(s) may suitably be placed on the patient's limb so that the doctor can also pay attention to anatomically relevant circumstances, such as varicose veins, wounds, fractures etc., which is not the case according to the prior art that makes use of pressure chambers in an enclosure to be placed around the leg/arm.

Such a contractile sleeve element functioning by air-evacuation further entails specific advantages particularly associated with the manner in which a number of sleeve elements wrapped around the patient's limb is sequentially controlled. These advantages will be more specifically stated later on.

According to a preferred embodiment of the invention said sleeve means may have a substantially rectangular cross-section, the larger face of which corresponding to the long side of the rectangle is adjacent to and connected with the supporting strip. This embodiment ensures the most advantageous pressure distribution across the total width of the supporting strip.

It is appropriate that the supporting strip has a larger length than said sleeve means and projects at either end of said sleeve means and is provided with fastening means of a type known per se, for instance a hook and loop strip of the "Velcro"-type, for fastening the strip ends together. Such a design entails the advantage that one single type of sleeve element or possibly two types with supporting strips of different length is/are sufficient for a peristaltic treatment of any portion of the patient's limb, provided the doctor or the staff undertakes the necessary adjustment when fastening the ends of the strip.

In this respect it should be observed that if part of the circumference of the patient's limb is "outside" the part of the circumference covered by said sleeve means, it will do no particular harm to the treatment proper since the strip contributes to distributing the pressure actuation and since the doctor according to circumstances may fasten the free ends of the strip at any convenient point on the limb.

It is expedient that said sleeve means consists of flexible material of comparatively small wall thickness and that the wall of said sleeve means or the internal face or external face of said sleeve means is provided with at least one reinforcing means so as to obtain the desired larger capability of deformation in the longitudinal direction than in the transversal direction of said sleeve means. Such reinforcing means contribute to allowing said sleeve means to work like bellows and to contract when the air is evacuated.

The invention also relates to a compression stocking with a control arrangement for peristaltically treating patients' extremities and of the kind including a number of contractile sleeve elements of the above mentioned type, and means for activating the sleeve elements, means for temporarily establishing two successive, mutually varying pressure conditions in the individual sleeve elements, and sequence controlling means, said compression stocking and its associated control arrangement being according to the invention characterized in that the individual sleeve elements are provided with a respective electrically actuable magnetic valve which in the dormant condition is open and that each individual sleeve element is in communication with a pipe conduit connected to a vacuum source. There is also provided a preferably electronic, sequence control circuit intended, in order to effect a peristaltic treatment by sequentially activating the contractile sleeve elements, to close a magnetic valve that is open in the dormant state between the pipe conduit and the atmosphere, and to substantially simultaneously open a normally closed magnetic valve inserted in the pipe conduit of the vacuum source, and subsequently to sequentially open the magnetic valves of the individual sleeve elements in the desired order for peristaltic treatment, and to re-establish atmospheric pressure, after the last sleeve element in succession has been activated, in the individual sleeve elements simultaneously or sequentially by closing the magnetic valve of the vacuum source and opening the magnetic valve to atmosphere.

BRIEF DESCRIPTION OF THE DRAWINGS

The invention will now be explained in more detail with reference to the schematical drawings, in which FIGS. 1 and 2 illustrate the basic principle of the invention, FIG. 3 is an example of designing a longitudinally contractile sleeve means of the type mentioned with reference to FIG. 1, FIG. 4 illustrates the function of a sleeve means when wrapped around a cylindrical body, FIG. 5 illustrates an embodiment of a sleeve element according to the invention.

DETAILED DESCRIPTION OF PREFERRED EMBODIMENT(S)

Figure 6:
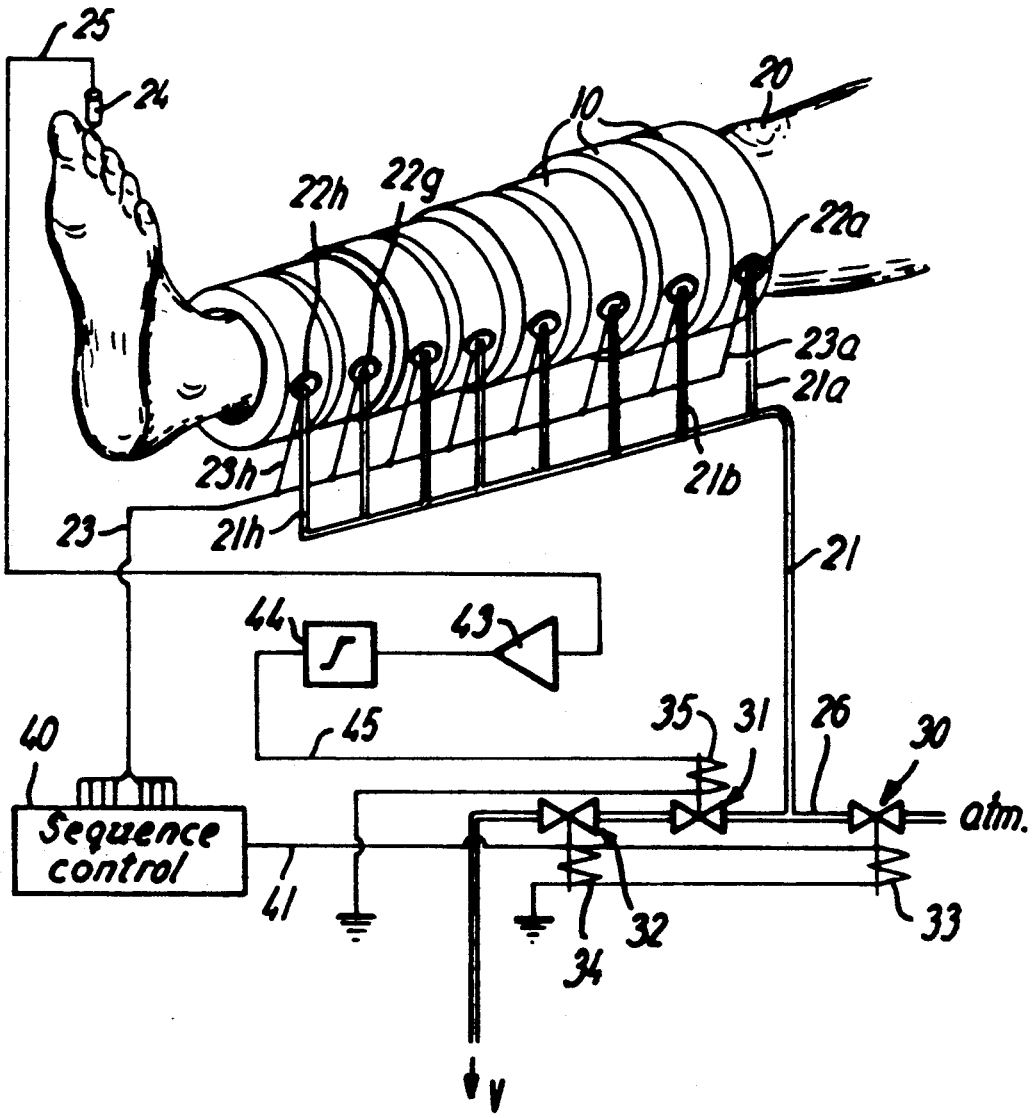
FIG. 6 is an example of a compression stocking with a control arrangement in accordance with the invention, placed around a patient's leg.

FIG. 1 to 3 illustrate the basic idea of the design of a contractile sleeve element according to the invention.

FIG. 1 shows a sleeve means 1 of flexible material, e.g. plastic material. Sleeve 1 is closed at one end 1*a*, while the opposite end wall is connected to a vacuum pump, not shown, in such a manner that air may be evacuated from the air evacuation chamber in the interior of the sleeve. The sleeve is capable of being deformed substantially more in the longitudinal direction ($L_1$), but it has no or substantially no such capability in the diametrical direction, the sleeve having practically constant inner width.

When the chamber in the sleeve is evacuated of air, it will contract in the longitudinal direction, i.e. have a length $L_2$ lesser than $L_1$. As the sleeve virtually does not change its diameter, the longitudinal shortening will be directly proportional to the volume of the evacuated air. If, for instance half of the air within the sleeve is evacuated, $L_2=0.5\ L_1$.

If the sleeve is now bent into a ring 2 as shown in FIG. 2, i.e. having approximately the same shape as the inner rubber tube of an automobile tire, and the above provision is still valid—the internal air evacuation chamber of the annular sleeve is only in communication with the vacuum connection V—the sleeve will not change its width when evacuated of air, only its length, i.e. the diameter of the ring. The circle 3 shown in dashed lines in FIG. 2 reflects said diameter reduction.

To obtain a sleeve capable of being deformed in the longitudinal direction but not or substantially not in the diametrical direction, the sleeve may be made from a soft material, e.g. plastic material, with elements of substantially more rigid material, e.g. plastics, being cast in the wall thickness of the sleeve. FIG. 3 illustrates a possible embodiment in which the element that is stiffening in the diametrical direction is constituted by a coil 4 flexible in the axial direction. Instead of such a coil an alternative solution consists in making use of rings of substantially more rigid material than that of the sleeve wall proper, said rings, not shown in the drawings, being spaced apart in planes perpendicular to the axial direction of the sleeve.

FIG. 4 illustrates a situation in which the sleeve 5 has a rectangular aperture in the clear, is still in communication with the vacuum connection V and is laid around a mainly circular-cylindrical body 6. When air is evacuated from the encircling sleeve 5, partial vacuum will occur in the interior of the annular sleeve and a corresponding force will be directed towards the axis of cylindrical body 6. if d designates the diameter of the cylindrical body, $P_{vac}$ is the partial vacuum occurring due to the vacuum connection (V) and h is the radial height of the sleeve, i.e. corresponding to the short side of the rectangular aperture of the sleeve, pressure P towards the surface of cylindrical body 6 may be expressed in formula:

$$P = \frac{(1 = P_{vac}) \times h}{d}$$

This is the basic principle which the invention uses for providing sleeve elements for peristaltically treating a patient's extremities.

FIG. 5 illustrates a preferred embodiment of such a sleeve element.

The sleeve 10 made from soft material, e.g. plastic material has a rectangular cross-section in the same manner as already explained with reference to FIG. 4. Said sleeve is structured as a bellows as indicated by the edge lines 11.

One of the larger faces the sleeve is connected with, e.g. adhered, to support strip 12 of flexible material, e.g. fabric. Sleeve 10 covers only part of the length of said textile strip 12 and one end or both ends of said textile strip 12 is/are provided with a piece of hook and loop fabric of the so-called "Velcro"-type, thereby allowing said two ends of the strip to be fastened together as shown at 13.

The one end 10*a* of sleeve 10 is sealed and at the opposite end 10*b*, which is sealed too, the internal chamber of the sleeve communicates only with a tube 14 for vacuum connection as shown by arrow V.

As it will be explained later on with reference to FIG. 6, at least one sleeve element 10 is wrapped for instance around a patient's leg in the same way as sleeve 5 is wrapped around body 6 in FIG. 4.

Sleeve element 10 is wrapped around the patient's leg so that the element is not too tight around the leg when the element is not coupled to a vacuum source or when the vacuum connection is interrupted (this will be explained in detail later on). Such a wrapping operation for instance carried out by a doctor, is easy to make, because the element and the associated strip are flexible and the two free ends of strip 12 make it possible to follow the shape and musculature of the leg, e.g. arrangement at the ankle or higher up at calf or thigh.

A sleeve element 10 so wrapped around the patient's leg contracts around the leg as soon as the element is connected to a vacuum source.

FIG. 6 shows how a number of such sleeve elements 10—in total eight in FIG. 6—is wrapped around a patient's leg as shown at 20.

In this respect, it is important to emphasize that FIG. 6 for the sake of clearness only shows contractile sleeve elements 10 from the patient's ankle up to his knee, but in order to prevent stasis in foot, one or more similar sleeve elements are usually also placed around the patient's foot and more sleeve elements may be arranged around the patient's thigh.

In the situation illustrated in FIG. 6, sleeve elements 10 are supposed to be fastened together, i.e. Velcro-locked on the inner side of the leg, and that is why the interlocked strip ends are not shown in FIG. 6.

While FIGS. 1, 3 and 5 show vacuum connection V located at one end of the contractile element, FIGS. 2 and 4 show that the vacuum connection may be effected anywhere on the contractile element.

In the design example illustrated in FIG. 6 the individual contractile elements 10 communicate with a common pipe conduit 21 through a respective branch line 21*a* to 21*h*. Each element 10 is provided with a magnetic valve 22*a* to 22*h* with which the associated branch line 21*a* to 21*h* is connected in a manner known per se. Electric signal branch lines 23*a* to 23*h* connect the activation element (e.g. coil) of all the magnetic valves with a signal carrying cable 23. For the sake of clearness, FIG. 6 illustrates such signal conduits and the signal cable in one single line, but it is obvious to experts that the branch lines 23*a* to 23*h* may individually consist of two conductors or one conductor with a shield (coaxial conductor) while cable 23 may include the necessary number of conductors, in the illustrated situation e.g. 2×8 conductors or eight conductors plus a common shield.

A capillary pulse sensor with an associated signal carrying conductor 25 mounted on the patient's foot is shown at 24.

The remaining part of FIG. 6 illustrates a control arrangement for sequentially controlling the function of contractile elements 10.

Pipe conduit 21 is connected to a tube 26 whose one end is passed through a usually open magnetic valve 30 and whose other end passes through a pressure gauge 31, i.e. a magnetic valve having a pressure conditioned controlling function that will be explained in the following, and from there to an external vacuum connection or vacuum pump, not shown, as indicated by arrow V through a generally closed magnetic valve 32.

The control arrangement further includes an electronic, sequence control circuit 40 intended to emit via cable 23 a sequence of control signals—to be explained in detail in the following—to the magnetic valves 22*a* to 22*h* of the individual sleeve elements 10 and to emit activation pulses via a signal conductor 41 (dual conductor) to the drive coil 33 of magnetic valve 30 and the drive coil 34 of magnetic valve 32.

Signal conductor 25 from pulse sensor 24 is connected to the input of an amplifier 43, the output of which is connected to a detector 44 (threshold detector) that is connected over a conductor 45 to the drive coil 35 of pressure gauge 31.

As previously mentioned, magnetic valve 30 is of the type which is normally open, meaning that as long as its coil 33 receives no control signal from sequence control circuit 40, pipe conduit 21 and the associated branch lines 21*a* to 21*h* are at atmospheric pressure.

As mentioned in the foregoing, magnetic valve 32 is of the type normally closed, meaning that vacuum connection V is kept separated from pressure gauge 31, pipe conduit 21 and branch lines 21*a* to 21*h* as long as there is no activation signal from the sequence control circuit 40 to coil 34 of magnetic valve 32.

Magnetic valves 22*a* to 22*h* of sleeve elements 10 are of the type normally open, i.e. open as long as there is no activation signal on the associated coils.

Said particular choice of the "normal" condition of the magnetic valves, i.e. free of signals, is essential to the reliability of operation, because an electric misfunction. e.g. errors in the sequential control proper may result in the risk to the patient that one or mare sleeve elements 10 is/are kept in constricted state, thereby impeding normal blood circulation in the leg. Upon drop-out of control signals to magnetic valves 30 and 32 and 22*a* to 22*h*, valve 32 will close at once and valve 30 and 22*a* to 22*h* will open at once, thereby immediately re-establishing atmospheric pressure in the sleeve elements.

The sequence control circuit 40 which together with detector 44, amplifier 43 and possibly sensor 44, in a manner known per se, is supplied from a current source, not shown, and is intended to primarily activate coil 33 to close valves 30 and 22*a* to 22*h*, and to simultaneously or shortly after activate coil 34 to open valve 32, so that air is evacuated from the actual sleeve element 10 which will then constrict around the patient's leg at the ankle. After some adequate time the sequence control circuit 40 interrupts the signal to magnetic valve 22*h* of the following sleeve element 10 which is now constricting, and said sequence continues until the magnetic valve 22*a* of the last sleeve element is no longer activated and the corresponding element 10 constricts.

The sequence may continue by closing valve 32, and opening valve 30, thereby re-establishing atmospheric pressure in all sleeve elements 10, following which the magnetic valves of the sleeve elements are closed until the subsequent activation sequence takes place. However, the control sequence may as well be composed so that a re-establishment of atmospheric pressure is effected—thereby eliminating the compression—in reverse order of sequences, from the upper to the lower sleeve element.

Such an activating sequence entails that a peristaltic actuation is exerted on the patient's leg from the foot and upwards.

The pressure gauge has for its purpose to ensure that this control arrangement operates in respect of the condition of the actual patient and other medical aspects with respect to the treatment of the patient.

Capillary pulse sensor 24 senses the patient's pulse in a foot (or in a hand) and emits via conductor 25 a signal that is amplified in amplifier 43 from which the amplified signal is detected in detector 44, thereby making it possible to ascertain whether the pulse is below or above a suitable desired value and in dependence thereon to activate drive coil 35 of pressure gauge 31, which is a reduction valve. A reference pressure is thus determined and so also establishes a convenient operating point for the whole arrangement.

It is pointed out that the detailed design of the control circuit falls within the field of well known techniques of electronics and it is evident that experts are in a position to provide said circuit in a quite conventional manner with an appropriate duration of the individual, complete sequence, with an appropriate break between successive sequences and offering to the operating staff various possibilities of sequential adjustment.

It should further be observed that FIG. 5 illustrates an embodiment of a sleeve element, but it does not show the associated magnetic valve connectable to tube 14, and a considerably more simplified establishment of the whole arrangement for the doctor would, however, be to manufacture the sleeve elements with their magnetic valves mounted directly on sleeve 10 working as a bellows and which is actually the form on which FIG. 6 is based.

We claim:

1. In a contractile element for use in the peristatic treatment of a patient's extremities and of the type comprising at least one sleeve means (10) defining at least one air evacuation chamber and adapted to be wrapped in its longitudinal direction around a patient's limb, said sleeve means (10) being sealed at both ends and connected with a flexible supporting strip (12) adapted to be wrapped around the patient's limb, the improvement comprising: said sleeve means being formed of a material that has less resistance to deformation in its longitudinal direction than in its transversal direction, and including an opening (14) in the wall of said sleeve providing means for air-evacuation, said sleeve longitudinally and diametrically contracting to compress a patient's limb around which it is wrapped upon evacuation of air from the sleeve air evacuation chamber.

2. The improvement as claimed in claim 1, wherein said sleeve means (10) has a substantially rectangular cross-section, the larger face of which corresponds with the long side of the rectangle and is adjacent to and connected with the supporting strip (12).

3. The improvement as claimed in claim 1, wherein the supporting strip (12) has a larger length than said sleeve means and projects at either end of said sleeve means and is provided at its end area with fastening means for fastening the strip ends together.

4. The improvement as claimed in claim 1, wherein said sleeve means (10) consists of flexible material of comparatively small wall thickness and wherein the wall of said sleeve means, including selectively the internal face or external face of said sleeve means, is provided with at least one reinforcing means (4) so as to obtain the desired large capability of deformation in the longitudinal direction than in the transversal direction of said sleeve means.

5. The improvement as claimed in claim 4, wherein the reinforcing means comprises a coil (4) of relatively rigid, resilient material.

6. The improvement as claimed in claim 4, wherein the reinforcing means comprise rings or profiles of comparatively rigid material, said rings or profiles being spaced apart in planes substantially perpendicular to the longitudinal axis of said sleeve means.

7. A compression stocking with a control arrangement for peristaltically treating patients' extremities, comprising a number of contractile sleeve elements wherein the individual sleeve elements are provided with a respective electrically actuable magnetic valve (22*a* to 22*h*) which is open in the dormant state and wherein each individual sleeve element is in communication with a conduit (21) connected to a vacuum source (V), and wherein, in order to effect a peristaltic treatment by sequentially activating the contractile sleeve elements; there is provided a sequence control circuit (40) arranged to close a normally open magnetic valve provided between the pipe conduit (21) and atmosphere, and to substantially simultaneously open a normally closed magnetic valve (32) provided in the conduit (21) for the vacuum source (V), and subsequently to sequentially open the magnetic valves (22*g* to 22*a*) of the individual sleeve elements in the desired order for peristaltic treatment, and to re-establish atmospheric pressure, after the last one of said sleeve elements has been activated, in the individual sleeve elements simultaneously or sequentially by closing the magnetic valve (32) for the vacuum source (V) and opening the magnetic valve (30) to atmosphere.

8. A compression stocking as claimed in claim 7, wherein the control arrangement includes a capillary pulse sensor (24) disposed at the patient's foot for generating a capillary pulse signal, an amplifier (43) connected to said sensor and intended to amplify the capillary pulse signal from the sensor, a threshold detector (44) connected to the amplifier (43) and a magnetically actuable pressostat (31) connected to the detector (44) and inserted in the conduit (21) upstream of the magnetic valve (32) for the vacuum source (V) and arranged to define a reference pressure below atmospheric in the pipe conduit (21) and the sleeve elements (10) in response to the capillary pulse signal.

* * * * *